US005157421A

United States Patent [19]

Kitahara

[11] Patent Number: 5,157,421

[45] Date of Patent: Oct. 20, 1992

[54] INK CARTRIDGE

[75] Inventor: Kohei Kitahara, Suwa, Japan

[73] Assignee: Seiko Epson Corporation, Tokyo, Japan

[21] Appl. No.: 719,082

[22] Filed: Jun. 4, 1991

Related U.S. Application Data

[63] Continuation of Ser. No. 419,905, Oct. 11, 1989, abandoned.

[30] Foreign Application Priority Data

Oct. 14, 1988 [JP] Japan ..... 63-258825

[51] Int. Cl.[5] ..... B41J 2/175

[52] U.S. Cl. ..... 346/140 R

[58] Field of Search ..... 346/140 R

[56] References Cited

U.S. PATENT DOCUMENTS

| | | | |
|---|---|---|---|
| 4,429,320 | 1/1984 | Hattori | 346/140 |
| 4,524,365 | 6/1985 | Kakeno | 346/140 X |
| 4,695,824 | 9/1987 | Tazaki | 346/140 R |
| 4,901,094 | 2/1990 | Iwagami et al. | 346/140 R |
| 4,928,126 | 5/1990 | Asai | 346/140 R |

FOREIGN PATENT DOCUMENTS

| | | |
|---|---|---|
| 3612299 | 10/1986 | Fed. Rep. of Germany . |
| 3819719 | 12/1988 | Fed. Rep. of Germany . |
| 108153 | 6/1983 | Japan . |
| 4569 | 11/1984 | Japan . |
| 12352 | 1/1986 | Japan . |
| 61-237649 | 10/1986 | Japan . |

OTHER PUBLICATIONS

Epsun K. K., "Ink Cartridge", vol. 7, No. 215 (M-244), pp. 283-285, Sep. 22, 1983.

L. Pietraszkiewicz, et al., "Internal Cleaning Unit Resolves Traditional Ink-Jet Limitations", Computer Technology Review, 4(1984) No. 4, pp. 137-139, Fall, 1984.

*Primary Examiner*—Benjamin R. Fuller
*Assistant Examiner*—Alrick Bobb
*Attorney, Agent, or Firm*—W. Douglas Carothers, Jr.

[57] ABSTRACT

An ink cartridge for an ink jet printer comprises an ink supply container in the form of an ink bag and a waste ink recovery returner for recovering waste ink, which are both housed within the same cartridge chamber and wherein the waste ink recovery retainer comprises a waste ink bag including a polymeric absorber therein. The polymeric absorber of this invention has great absorption capabilities with a volume requirement of about one-half to one-tenth of that compared to porous absorption members utilized in the prior art and are still capable of absorbing the entire volume of ink within the ink bag. This permits a large reduction in cartridge volume and permits sharing of same cartridge chamber volume by both bags due to the continual exchange of ink from one bag to another. As a result, it becomes possible to further reduce the size of the entire ink jet printer and its printing mechanism.

36 Claims, 4 Drawing Sheets

PRIOR
ART

INK CARTRIDGE

This is a continuation of copending application Ser. No. 07/419,905 filed Oct. 11, 1989 now abandoned.

BACKGROUND OF THE INVENTION

This invention relates generally to an ink cartridge for an ink jet printer having ink supply and waste ink recovery means and more particularly to the construction of an ink cartridge having a housing section containing an ink supply section and a waste ink recovery section.

FIG. 1 illustrates a conventional ink cartridge 60 for an ink jet printer comprising two sections: a waste ink recovery section 63 and ink bag or supply section 64. Sections 63 and 64 are partitioned by an inner wall or lid 51 forming separated housing chambers. Section 64 contains an ink bag 61 coupled to outlet port 65, and section 63 contains an absorber 62 in fluid communication with inlet port 66.

Another example of a conventional ink cartridge is disclosed in Japanese Patent Laid Open No. 108153/1983. The ink cartridge in this patent discloses an ink bag and a porous ink absorber for absorbing waste ink within the same chamber containing the ink bag.

The problem encountered in connection with the two sections of ink cartridge 60 in FIG. 1 is that it is necessary to have a sufficiently large waste ink recovery section 63 to contain an absorber having a volume capable of recovering the entire volume of ink supply contained in ink bag 61. This capability is provided to cover the unlikely event of recovering all ink that may be dispensed from bag 61. As a result, the volume of waste ink recovery section 63 has to be substantially the same as the volume of ink supply section 64, and, as a result, the volume of the entire ink cartridge 61 is large in order to accommodate the entire ink supply volume in either section of the cartridge. This is also true in the case of cartridge of Japanese Patent Laid Open No. 108153/1983 wherein a large volume porous or sponge-like absorber brings about no change in the volume of the waste ink recovery section before absorption of ink so that it is necessary to initially include in the design of the ink cartridge an absorber having a volume sufficient to absorb the entire volume of ink supply within the cartridge ink bag. Thus, as in the case of ink cartridge 60 having separated waste ink recovery and ink supply sections, the total volume of the ink cartridge is also large.

It is an object of this invention to provide an ink cartridge wherein the size of the cartridge is remarkably reduced while providing a waste ink recovery means which can adequately accommodate the entire volume of the ink supply means.

SUMMARY OF THE INVENTION

According to this invention, an ink cartridge for an ink jet printer comprises an ink supply means in the form of an ink bag and a waste ink recovery means for recovering waste ink, which are both housed within the same cartridge chamber, and wherein the waste ink recovery means comprises a waste ink bag including a polymeric absorber therein. The polymeric absorber of this invention has great absorption capabilities with a volume requirement of about one-half to one-tenth of that compared to the previously mentioned porous members utilized in the prior art and are still capable of absorbing the entire volume of ink within the ink bag. Therefore, at the outset, a much smaller volume of absorptive polymer is necessary in the waste ink bag. Further, in employing a single chamber or section for both the ink bag and the waste ink bag, the volume increase in the waste ink bag upon recovery of waste ink can be offset by the volume decrease in the ink supply bag in supplying ink to an printer ink jet printing mechanism. This enables a remarkable reduction in the size and volume of the ink cartridge as compared to the ink cartridge design that includes a space for recovering waste ink. Because of the savings in cartridge space due to the use of a polymeric absorber and sharing of same cartridge chamber volume due to exchange of ink from one bag to another, it is also possible to consider as well as accommodate a reduction in the size of the entire ink jet printer and its printing mechanism.

The waste ink bag may further include an air vent or hole to permit air displacement and arranged in such a manner so as not to easily permit leakage of ink from the waste bag. Alternatively, a membrane impervious to liquid, but not air, may be provided over the air vent opening. In any case, the absorption holding power of the polymeric absorber per se generally provides sufficient means to prevent any liquid ink leakage via the waste ink bag air vent.

The polymeric absorber of this invention may be comprised of a member selected from the groups consisting of a starch-based acrylic acid graft polymerization product, a polyacrylic acid salt-based polymer, a vinyl alcohol-acrylic acid salt-based polymer, a PVA-based polymer and an isobutylene-maleic anhydride polymer.

The forgoing features bring about a remarkable reduction in the cost of the ink cartridge by virtue of utilizing an absorber that requires less volume and, further, a reduction in overall cartridge size per se compared to ink cartridges of the prior art.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 2:
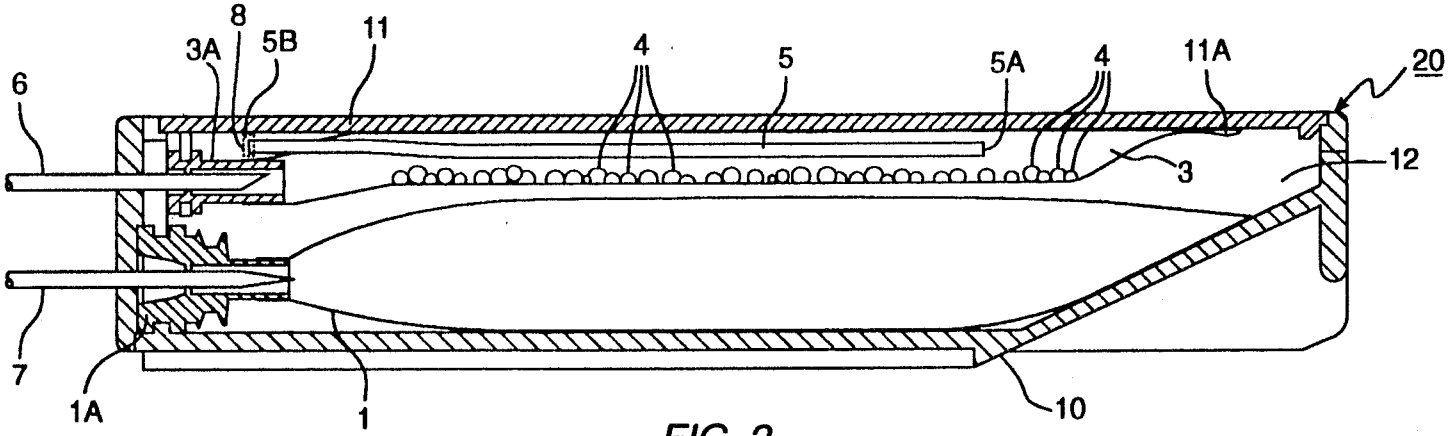
FIG. 2 is a cross sectional illustration of a first embodiment of an ink cartridge of this invention.

Reference is now made to FIG. 2 wherein there is described a first embodiment of this invention. Ink cartridge 20 comprises a container or housing 10 having a single chamber 12 containing ink supply means in the form of ink bag 1 and ink recovery means in the form of waste ink bag 3. Ink bag 1 is comprised of a sheet or film material, such as a multiple layer film. An example of such a film is a combination of film layers comprising an outer nylon film and an inner polyethylene film between which is provided a thin metal film, such as aluminum. An outlet port 1A is welded to ink bag 1 via, for example, heat welding. Ink bag 1 is then secured to the bottom portion of housing 10, for example, by means of a hot calking material, an adhesive medium, heat sealing or a pressure sensitive double coated adhesive tape. Ink outlet port 1A is secured to the forward end of cartridge housing 10 in a manner known in the art. Also, as known in the art, an ink supply line 7 is provided through the central opening of outlet port 1A for communication with ink bag 1 to permit the flow of ink in line 7 to an ink jet printing mechanism (not shown).

Waste ink recovery bag 3 is comprised of a sheet or film material, such as a multiple layer film, for example, a combination outer nylon film and inner polyethylene film. Bag 3 is fixed to the undersurface of cartridge lid 11 at region 11A, for example, by means of a hot calking material, an adhesive, heat sealing or pressure sensitive double coated adhesive tape. Waste ink recovery inlet port 3A is welded to waste ink recovery bag 3 employing, for example, heat welding and is also secured to the forward end of lid 11 in a manner known in the art. As shown in FIG. 2, closure of lid 11 onto housing 10 brings the forward end of port 3A in engagement against support means for port 1A. Waste ink recovery line 6 is provided through the central opening of waste ink inlet port 3A for communication with waste ink bag 3 to permit recovered ink to flow from line 6 into bag 3.

Figure 1:
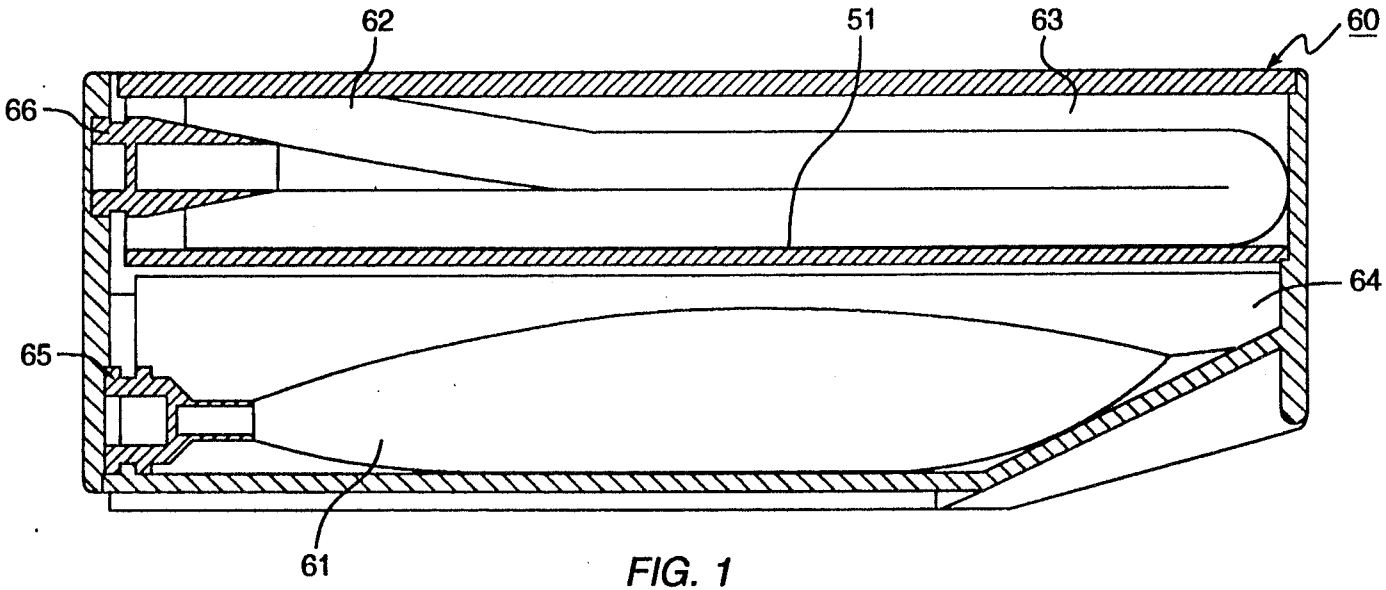
FIG. 1 is a cross sectional illustration of a conventional ink cartridge known in the art.

In utilization of ink cartridge 20, the cartridge is inserted into a cartridge holder (not shown). Ink is fed from ink bag 1 through outlet port 1A to line 7 and waste ink is recovered through inlet port 3A from line 6 into waste ink bag 3. As the amount of waste ink increases in waste ink recovery bag 3, bag 3 expands in size while ink bag 1 shrinks in size as ink is withdrawn therefrom for use in printing. Both bags are thereby able to share the smaller volume capacity of cartridge 20 compared to the larger volume capacity of cartridge 60 shown in FIG. 1.

A polymeric absorber 4 is included within waste ink bag 3 and comprises absorptive polymer. Examples of such absorbers are a starch-based acrylic acid graft polymerization product, a polyacrylic acid salt-based polymer, a vinyl alcohol-acrylic acid salt-based polymer, a PVA-based polymer and an isobutylene-maleic anhydride polymer. Polymeric absorber 4 has a weight, for example, in the range of 1 g to 10 g. This small amount is sufficient per se to absorb the volume of ink within ink bag 1. Since polymeric absorber 4 has large expansive capabilities, and in its initial state, as shown in FIG. 2, it is of very small volume and weight compared to the volume and weight of ink within ink bag 1 and, therefore, provides a substantial savings in space or volume of ink cartridge 20. As an example, absorber 4 is as small as about one-twentieth (1/20) to one-one hundredth (1/100) of the weight of the ink contained in ink bag 1.

An air evacuation or vent tube 5 is positioned within waste ink bag 3 having one end 5A thereof located in waste ink recovery bag 3 a substantial distance away from inlet port 3A and the other end 5B extending through the wall of bag 3 for exposure to the interior of chamber 12. Tube 5, therefore, provides an air passage and communication from within bag 3 to the exterior of bag 3 and chamber 12. Since ink recovered via line 6 and flowing into waste ink bag 3 will also contain some air, tube 5 provides a vent for the removal of such air from within bag 3 into chamber 12 and to the outside of cartridge 20.

As an additional approach for preventing any possibility of ink from flowing through tube 5 into chamber 12, a liquid impermeable and air permeable liquid repellant membrane 8 may be provided on end 5B permitting the passage of air into chamber 12 but not liquid ink. However, in most instances, membrane 8 is not required because the absorptive holding power of polymeric absorber 4 is sufficient to retain all liquid ink and prevent the possibility of any ink flow into and through tube 5 into chamber 12.

Specific examples of polymeric absorber 4 include a starch-based acrylic acid graft polymerization product (e.g., Sanwet manufactured by Sanyo Chemical Industry Ltd., WAS manufactured by Nippon Starch Chemical Co., Ltd., and Jell Fine manufactured by Daicel Chemical Industries, Ltd.), a polyacrylic acid salt-based polymer (e.g., Aqua Keep manufactured by Seitetsu Kagaku Co., Ltd., Aqualick Calif. manufactured by Nippon Shokubai Kagaku Kogyo Co., Ltd., Krisper manufactured by Arakawa Chemical Industries, Ltd., Turfine manufactured by Kao Corp. and Exlana manufactured by Nippon Exlan Corp.), a vinyl alcohol acrylic acid salt-based polymer (Sumika Gel manufactured by Sumitomo Chemical Co., Ltd.), a PVA-based polymer (GP manufactured by Nippon Syntheric Chemical Industry Co., Ltd.) and a isobutylene-maleic anhydride-based polymer (KI gel manufactured by Kuraray Isoprene Chemical Co., Ltd.). At least one of the forgoing is employed as the polymeric absorber.

Some polymeric absorbers have poor absorption qualities relative to their use in connection with strong alkaline inks. Such alkaline inks are preferred because of their ease of being quickly absorbed into recording mediums and because of their quick drying capability. However, in such a situation, adequate absorption quality is obtained for such inks if a polymeric absorber 4 comprising starch-based acrylic acid graft copolymerization product is employed as the absorptive polymer. Specific examples comprise Sanwet IM-300, IM-1000, IM-2200 and IM-5000G manufactured by Sanyo Chemical Industries, Ltd.

The absorptive polymers of this invention have high absorption capabilities, i.e. capable of absorbing an entire ink supply volume supplied with such cartridge but with a volume requirement of about one-half to one-tenth of that compared to absorption members previously employed in the art.

Figure 3:
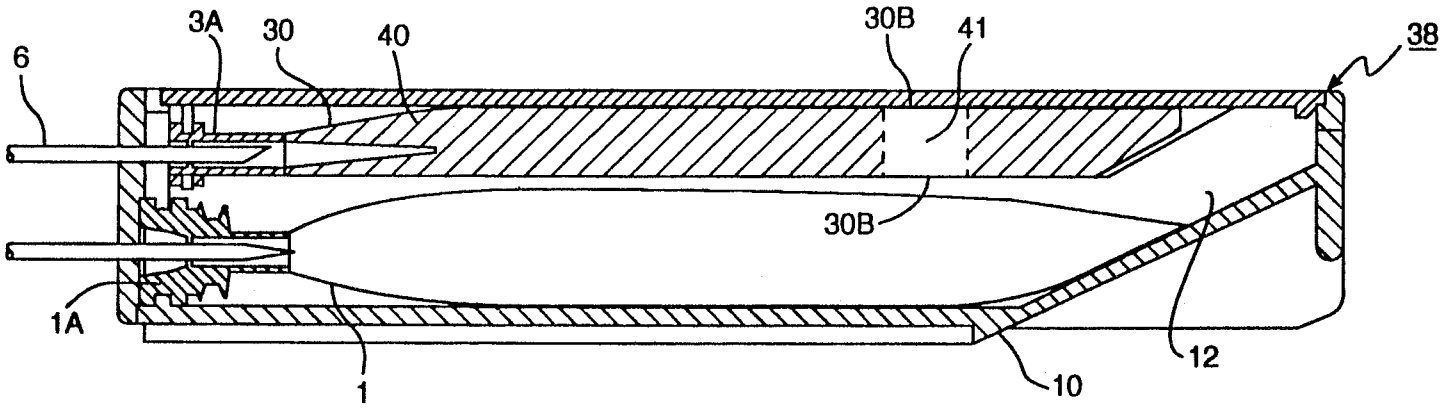
FIG. 3 is a cross sectional illustration of a second embodiment of an ink cartridge of this invention.
Figure 4:
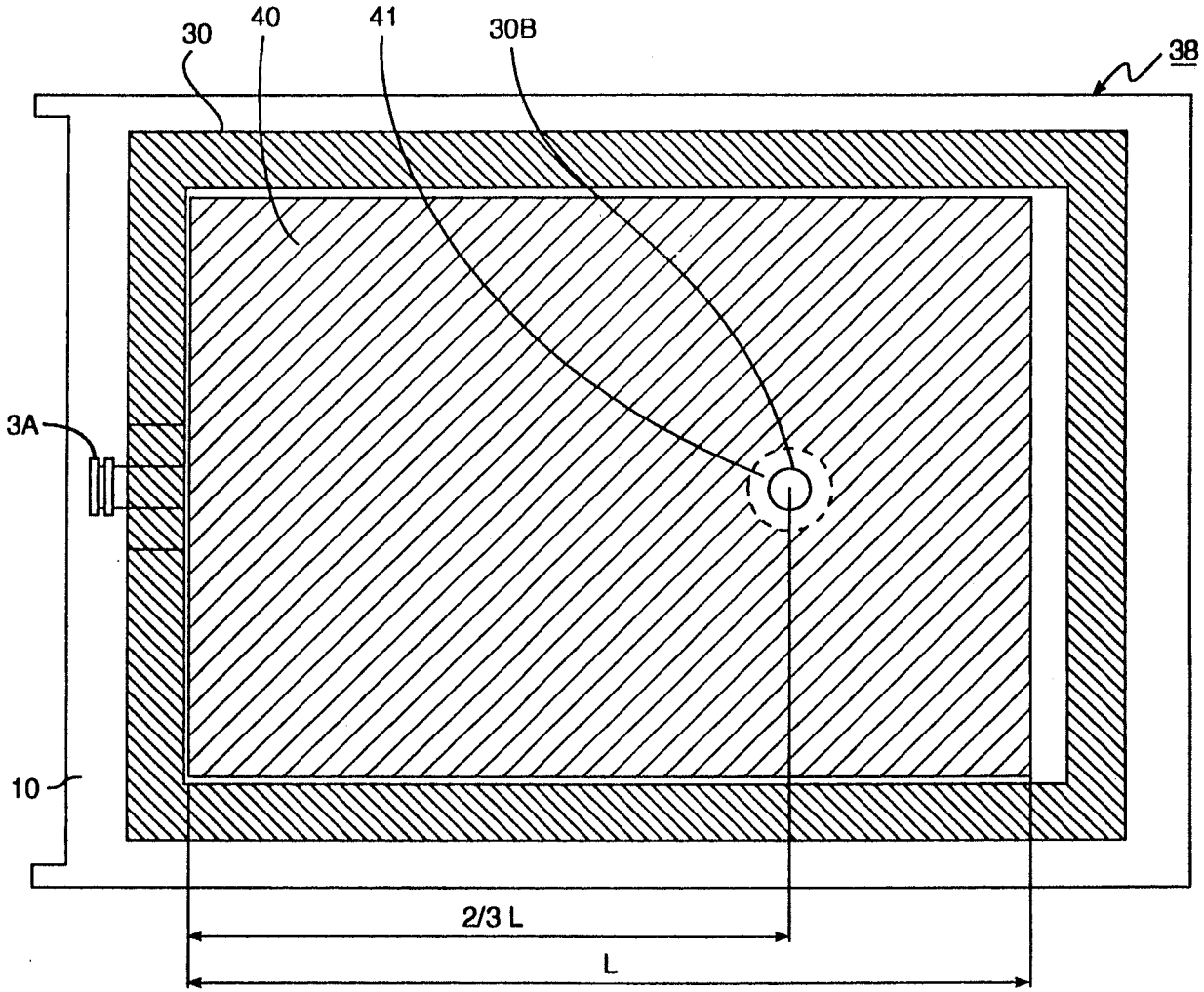
FIG. 4 is a plan view of the second embodiment of this invention.

Reference is now made to the second embodiment of this invention shown in FIGS. 3 and 4. Ink cartridge 38 is the same as ink cartridge 20 in overall construction so that numeric identification for like components is the same and, therefore, the description thereof is equally applicable here and need not be repeated. Of particular interest in the second embodiment is waste ink recovery bag 30 and the absorber employed therein. Absorber 40 is a nonwoven type fabric comprising, for example, a high absorptive cotton-like material impregnated with an absorptive polymer or comprising, for example, a plurality of multiple layers of an absorptive polymer in combination with one or more nonwoven fabric layers. The absorptive polymer of the multiple layers may be different than the absorptive polymer employed in the nonwoven fabric layer. Fabric/polymeric absorber 40 is then sealed within waste ink recovery bag 30. Absorber 40 is provided with an air vent 41 and waste ink recovery bag 30 is also provided with an air vent 30B. Air vents 30B and 41 may be aligned relative to one another.

As illustrated in FIG. 4, both waste ink bag air vent 30B and absorber air vent 41 are located at the same site and are at a location remote from recovery inlet port 3A, which location approximates a region of absorber 40 that is the last region for the penetration and absorption of waste ink. This position has been determined by experiment to be approximately $\frac{2}{3}$L, where L equals the length of absorber 40, and is the approximate region in absorber 40 of lowest absorption during the process of waste ink recovery of ink from bag 1 and, further, is the last region of absorber 40 subjected to any significant ink waste absorption within absorber 40. This region is a substantial distant away from recovery inlet port 3A. In the example here, polymeric absorber 40 has an aligned air vent 41 with air vent 30B of bag 30 and is located a distance of about $\frac{2}{3}$L from recovery inlet port 3A.

Combination fabric, polymeric absorber 40 has absorbing qualities similar to an absorptive paper towel or napkin and functions to absorb waste ink without liquid runoff through vents 41 and 30B because of its great absorptive power as particularly enhanced by the presence of an absorptive polymer. As a result, only air is vented out of vents 41 and 30B into chamber 12 without being accompanied with any notable liquid content.

While the invention has been described in conjunction with specific embodiments, it is evident to those skilled in the art that many further alternatives, modifications and variations will be apparent in light of the forgoing description. Thus, the invention described herein is intended to embrace all such alternatives, modifications, applications and variations as fall within the spirit and scope of the appended claims.

What is claimed is:

1. An ink cartridge comprising a sealed housing having a single chamber within which is provided ink supply means and a pliable waste ink recovery means, said ink supply means and said pliable waste ink recovery means being liquid impervious to an interior of said chamber, said ink supply means comprising a pliable ink supply bag containing a supply of ink dispensed from said ink supply bag through an outlet port in said cartridge, said pliable waste ink recovery means for return of waste ink received directly into an interior of said waste ink recovery means through a directly coupled and contained communication connection provided through an inlet port in said cartridge so that said returned waste ink contained within said waste ink recovery means is received therein without spillage into the interior of said chamber or out of said cartridge, said recovery means containing an absorber comprising an absorptive polymer, said chamber reduced in physical dimension to provide a more compact cartridge due to concurrent accommodation of said pliable ink supply bag when full in combination with said pliable waste ink recovery means when empty so that a decrease in volume provided in said chamber as said ink supply is exhausted is taken up by an increase in volume caused by absorption of said waste ink by said absorptive polymer.

2. The ink cartridge of claim 1 wherein said waste ink recovery means is provided with means to vent air trapped in said recovery means into said chamber.

3. The ink cartridge of claim 2 wherein said waste ink recovery means comprises a container bag with a waste ink recovery inlet port at one end thereof, said absorber comprising unwoven fabric means impregnated with said absorptive polymer, said air vent means comprising aligned apertures in both said fabric and said container bag and positioned a distance greater than half the length of said container bag from said one end thereof.

4. The ink cartridge of claim 3 wherein said aligned apertures are positioned about two thirds along the longitudinal length of said fabric means from said one end thereof.

5. The ink cartridge of claim 3 wherein said fabric means comprises a plurality of multiple layers of an absorptive polymer in combination with at least one nonwoven fabric layer impregnated with an absorptive polymer.

6. The ink cartridge of claim 1 wherein said polymeric absorber comprises a member selected from a group consisting of a starch-based acrylic acid graft polymerization product, a polyacrylic acid salt-based polymer, a vinyl alcohol-acrylic acid salt-based polymer, a PVA-based polymer and an isobutylene-maleic anhydride polymer.

7. The ink cartridge of claim 1 wherein the ink in said ink supply means comprises an alkaline ink and said absorptive polymer comprises a starch-based acrylic acid graft copolymerization product.

8. The ink cartridge of claim 1 wherein said pliable ink supply bag comprises a multiple layer film having outer organic layers separated by a metallic layer.

9. The ink cartridge of claim 8 wherein said ink supply bag comprises an outer layer of nylon and an inner layer of polyethylene with a thin aluminum layer therebetween, the bag for said waste ink recovery comprising an outer layer of nylon and an inner layer of polyethylene.

10. The ink cartridge of claim 1 wherein said waste ink recovery means comprises a pliable container bag.

11. The ink cartridge of claim 10 wherein said pliable ink supply bag is attached to a first wall in said chamber and said pliable waste ink recovery bag is attached to a wall opposite to said first wall in said chamber to aid in providing said concurrent accommodation.

12. The ink cartridge of claim 11 wherein said polymeric absorber comprises a member selected from a group consisting of a starch-based acrylic acid graft polymerization product, a polyacrylic acid salt-based polymer, a vinyl alcohol-acrylic acid salt-based polymer, a PVA-based polymer and an isobutylene-maleic anhydride polymer.

13. The ink cartridge of claim 1, 2 or 10 wherein said absorber comprises unwoven fabric means uniformly impregnated with said absorptive polymer.

14. The ink cartridge of claim 1 wherein said waste ink recovery means comprises high absorptive cotton-like material impregnated or layered with said absorptive polymer.

15. The ink cartridge of claim 14 wherein said waste ink recovery means is provided with means to vent air trapped in said recovery means into said chamber.

16. The ink cartridge of claim 15 wherein said vent means comprises a combination air vent in said cotton-like material and air vent in said waste ink recovery bag.

17. The ink cartridge of claim 16 wherein said air vents are located approximately two-thirds distance of the length of said waste ink recovery bag from said inlet port.

18. The ink cartridge of claim 16 wherein said air vents are apertures in said cotton-like material and said waste ink recovery bag.

19. The ink cartridge of claim 18 wherein said air vents are located approximately two-thirds distance of the length of said waste ink recovery bag from said inlet port.

20. The ink cartridge of claim 1 wherein said pliable waste ink recovery means is positioned above said pliable ink supply bag in said cartridge chamber.

21. The ink cartridge of claim 20, wherein a top surface of said pliable waste ink recovery means is tacked to an inside surface of a top wall of said cartridge and a bottom surface of said pliable ink supply bag is tacked to an inside surface of a bottom wall of said cartridge.

22. An ink cartridge comprising a housing having a single chamber within which is provided ink supply means comprising a pliable ink supply bag containing a supply of ink dispensed from said ink supply bag through an outlet port in said cartridge and a waste ink recovery means for the return of waste ink received into said waste ink recovery means through an inlet port in said cartridge, said recovery means containing an absorber comprising an absorptive polymer, said chamber reduced in physical dimension due to the concurrent accommodation of said pliable ink supply bag when full in combination with said pliable waste ink recovery means when empty so that with a decrease in volume provided in said chamber as said ink supply is exhausted is taken up by an increase in volume caused by absorption of said waste ink by said absorptive polymer, said waste ink recovery means comprises a pliable container bag and is provided with means to vent air trapped in said recovery means into said chamber, said air vent means comprises a tube having one end in said bag and another end outside of said bag in said chamber.

23. The ink cartridge of claim 22 wherein said tube has a liquid impermeable and air permeable membrane provided at said tube other end.

24. In an ink jet printer including a cartridge comprising a single, sealed chamber within which are provided in side-by-side relation a pliable ink supply means and a pliable waste ink recovery means, said pliable ink supply means and said pliable waste ink recovery means being liquid impervious to an interior of said chamber, said pliable ink supply means containing a supply of ink dispensed from said pliable ink supply means through an outlet port in said cartridge, said pliable waste ink recovery means containing an absorber comprising an absorptive polymer for return of waste ink received directly into an interior of said pliable waste ink recovery means through a directly coupled and contained communication connection provided through an inlet port in said cartridge so that said returned waste ink contained within said waste ink recovery means is received therein without spillage into the interior of said chamber or out of said cartridge, said chamber reduced in physical dimension due to concurrent accommodation of said ink supply means when full in combination with said ink recovery means when empty so that a decrease in volume provided in said chamber as said ink supply is exhausted is taken up by an increase in volume caused by absorption of said waste ink by said absorptive polymer.

25. The ink cartridge of claim 24 wherein said waste ink recovery means is provided with means to vent air trapped in said recovery means into said chamber.

26. In the ink jet printer of claim 25 wherein said air vent means comprises a tube having one end in said bag and another end outside of said bag in said chamber.

27. In the ink jet printer of claim 26 wherein a liquid impermeable and air permeable membrane is provided at said tube other end.

28. In the ink jet printer of claim 27 wherein said waste ink recovery means comprises a container bag with a waste ink recovery inlet port at one end thereof, said absorber comprising unwoven fabric means impregnated with said absorptive polymer, said air vent means comprising aligned apertures in both said fabric and said container bag and positioned a substantial distance from said one end thereof.

29. In the ink jet printer of claim 28 wherein said aligned apertures are positioned about two thirds along the longitudinal length of said fabric means from said one end thereof.

30. In the ink jet printer of claim 28 wherein said fabric means comprises a plurality of multiple layers of an absorptive polymer in combination with at least one nonwoven fabric layer impregnated with an absorptive polymer.

31. In the ink jet printer of claim 24 wherein said polymeric absorber comprises a member selected from a group consisting of a starch-based acrylic acid graft polymerization product, a polyacrylic acid salt-based polymer, a vinyl alcohol-acrylic acid salt-based polymer, a PVA-based polymer and an isobutylene-maleic anhydride polymer.

32. In the ink jet printer of claim 24 wherein the ink in said ink supply means comprises an alkaline ink and said absorptive polymer comprises a starch-based acrylic acid graft copolymerization product.

33. In the ink jet printer of claim 24 wherein said ink supply bag comprises a multiple layer film having outer organic layers separated by a metallic layer.

34. In the ink jet printer of claim 33 wherein said ink supply bag comprises an outer layer of nylon and an inner layer of polyethylene with a thin aluminum layer therebetween, the bag for said waste ink recovery comprising an outer layer of nylon and an inner layer of polyethylene.

35. In the ink jet printer of claim 24, said pliable ink supply means attached to a first wall in said chamber and said pliable waste ink recovery means attached to a wall opposite to said first wall in said chamber to aid in providing said concurrent accommodation.

36. An ink cartridge comprising a housing having a single sealed chamber impervious to a passage of liquid material either into or out of said chamber, an inlet port and outlet port formed through said housing wherein exterior portions of said ports with said housing are liquid impervious to the passage of liquid material either into or out of said chamber, said inlet port and outlet port each having a conduit for direct fluid communication with an interior of said chamber, a pliable ink container contained within said chamber containing a supply of ink and having an opening connected for direct, sealed fluid communication to said outlet port conduit in said housing, a waste ink recovery retainer within said chamber comprising an absorptive polymer material for receiving and absorbing waste ink returned through said inlet port conduit in said housing, said inlet port conduit in direct fluid communication for delivery of said return waste ink to said absorptive polymer material whereby said absorbed waste ink is retained within said chamber, wherein said chamber is reduced in physical dimension to provide a more compact cartridge due to concurrent accommodation of said ink container when full in combination with said waste ink recovery retainer when empty so that a decrease in volume provided in said chamber as said ink supply is exhausted is taken up by an increase in volume caused by absorption of said waste ink by said absorptive polymer.

* * * * *